US012644443B2

(12) United States Patent
Zhang et al.

(10) Patent No.: US 12,644,443 B2
(45) Date of Patent: Jun. 2, 2026

(54) COMPACT AIR COMPRESSOR

(71) Applicant: Changzhou Giant Electric Co., Ltd., Changzhou (CN)

(72) Inventors: Jian Zhang, Changzhou (CN); Lei Zhang, Changzhou (CN); Lifeng Gu, Changzhou (CN); Dong Wu, Changzhou (CN)

(73) Assignee: Changzhou Giant Electric Co., Ltd., Changzhou (CN)

( * ) Notice: Subject to any disclaimer, the term of this patent is extended or adjusted under 35 U.S.C. 154(b) by 0 days.

(21) Appl. No.: 19/340,911

(22) Filed: Sep. 26, 2025

(65) Prior Publication Data

US 2026/0022691 A1 Jan. 22, 2026

Related U.S. Application Data

(63) Continuation of application No. PCT/CN2025/094579, filed on May 13, 2025.

(30) Foreign Application Priority Data

May 14, 2024 (CN) ..... 202410592831.6

(51) Int. Cl.
*F04B 35/00* (2006.01)
*F04B 39/00* (2006.01)
(Continued)

(52) U.S. Cl.
CPC ..... *F04B 35/00* (2013.01); *F04B 39/0027* (2013.01); *F04B 39/066* (2013.01); *F04B 39/121* (2013.01)

(58) Field of Classification Search
CPC ..... F04B 35/00; F04B 35/01; F04B 35/04; F04B 35/06; F04B 35/066; F04B 39/121; F04B 41/02
See application file for complete search history.

(56) References Cited

U.S. PATENT DOCUMENTS

2007/0065311 A1* 3/2007 Chou ..... F04B 39/123 417/415
2015/0059570 A1* 3/2015 Hong ..... F04B 35/04 92/170.1
2024/0060483 A1 2/2024 Wu et al.

FOREIGN PATENT DOCUMENTS

CN 208951240 U 6/2019
CN 211852098 U 11/2020
(Continued)

*Primary Examiner* — Kenneth J Hansen
(74) *Attorney, Agent, or Firm* — Bayramoglu Law Offices LLC

(57) ABSTRACT

A compact air compressor is provided. A plurality of blades are disposed on a driving wheel that is disposed on a second output shaft of a motor; an extension portion perpendicular to a cylinder is disposed on a cylinder mounting seat; an inner side of the extension portion is arc-shaped to accommodate the driving wheel; a plurality of grooves are formed at an end of the extension portion to serve as an air inlet passage; corresponding locating holes are respectively formed in a motor mounting seat and the extension portion of the cylinder mounting seat; the driving wheel is inserted into the extension portion, and connected by a threaded rod penetrating through the locating hole in the motor mounting seat and the locating hole in the extension portion; and a driven wheel is in transmission connection with the driving wheel through a transmission belt.

7 Claims, 6 Drawing Sheets

(51) Int. Cl.
*F04B 39/06* (2006.01)
*F04B 39/12* (2006.01)

(56) References Cited

FOREIGN PATENT DOCUMENTS

| | | | |
|---|---|---|---|
| CN | 118188396 | A | 6/2024 |
| GB | 2205361 | A | 12/1988 |

* cited by examiner

COMPACT AIR COMPRESSOR

CROSS-REFERENCE TO THE RELATED APPLICATIONS

This application is a continuation application of International Application No. PCT/CN2025/094579, filed on May 13, 2025, which is based upon and claims priority to Chinese Patent Application No. 202410592831.6, filed on May 14, 2024, the entire contents of which are incorporated herein by reference.

TECHNICAL FIELD

The present disclosure relates to the technical field of compressors, and in particular to a compact air compressor.

BACKGROUND

Compressors are versatile mechanical devices that have a wide range of applications and play a vital role in various fields of modern industry and life. Compressors can be applied to refrigeration, engine operation, gas delivery, chemical processing, mechanical manufacturing, and almost any application requiring delivery or use of compressed gas. Small air compressors are typically used to inflate air cushions, tires, etc. Driven by a motor, a piston performs reciprocating compression actions in a cylinder, such that the compressed air can be delivered to a storage tank from the cylinder, inflating a target object through a delivery hose connected to a manifold on the storage tank.

Currently, commonly used air compressors are mainly piston air compressors and screw air compressors. Both types have shortcomings, despite their advantages. For example, piston air compressor mainly utilizes the rotational motion of the crankshaft to drive reciprocating linear motion of the piston, thereby compressing the air in the cylinder. The gear transmission suffers large noise and poor stability.

SUMMARY

In view of the technical problem of large noise of the piston air compressor, the present disclosure provides a compact air compressor. The present disclosure adjusts the gear transmission to belt transmission, improving the heat dissipation effect. Moreover, the present disclosure changes mounting manners of the motor portion and the cylinder and the power transmission portion, achieving noise reduction, and simplifying the mounting.

The present disclosure achieves the above technical objective through the following technical solutions.

A compact air compressor includes an air tank, a casing disposed on a top of the air tank, and a motor, a fan, a driving wheel, a driven wheel, a transmission belt, a cam, and a cylinder that are located in the casing, where the fan is disposed on a first output shaft of the motor; the driving wheel is disposed on a second output shaft of the motor; and a plurality of blades are disposed on the driving wheel;

the driven wheel is disposed on a connecting shaft that is connected to the cam; and a central shaft on the cam extends into a pivot hole at a free end of a piston rod of the cylinder;

an extension portion perpendicular to the cylinder is disposed on a cylinder mounting seat; an inner side of the extension portion is arc-shaped to accommodate the driving wheel; a plurality of grooves are formed at an end of the extension portion to serve as an air inlet passage; corresponding locating holes are respectively formed in a motor mounting seat and the extension portion of the cylinder mounting seat; and the driving wheel is inserted into the extension portion, and connected by a threaded rod penetrating through the locating hole in the motor mounting seat and the locating hole in the extension portion; and the driven wheel is in transmission connection with the driving wheel through the transmission belt.

Further, the driving wheel and the driven wheel each are a toothed wheel, and the transmission belt is a synchronous belt; and alternatively, the driving wheel and the driven wheel each are a multi-wedge belt pulley, and the transmission belt is a multi-wedge belt.

Further, the blades and the driving wheel are integrally formed or fixed by welding.

Further, a bearing is disposed at an end of the central shaft on the cam; and through contact between the bearing and an interior of the pivot hole of the piston rod, the piston rod is driven to move back and forth.

Further, an external extension portion extending circumferentially relative to an arc of an inner wall of the extension portion is disposed at an outer side of the extension portion; and an air vent is formed in the external extension portion.

Further, an air outlet of the cylinder communicates with the air tank through an air inlet tube and a one-way valve; the air tank communicates with an air outlet connector through an air outlet tube; and a first pressure gauge and a second pressure gauge that are respectively configured to detect an air pressure in the air tank and an air outlet pressure are disposed at the air outlet connector.

Further, a safety valve is disposed between the air outlet connector and the air outlet tube.

Further, an air outlet pressure adjusting device is disposed at the air outlet connector.

Further, a bearing is disposed between the first output shaft of the motor and the motor mounting seat, as well as between the second output shaft of the motor and the motor mounting seat.

Further, an air guide housing is disposed outside the fan.

Further, a heat sink is disposed outside the cylinder mounting seat; and a plurality of protrusions are disposed on an inner wall of an end cover of the cylinder mounting seat.

According to the compact air compressor provided by the present disclosure, by changing gear engaged transmission between the driven wheel and the driving wheel to belt transmission, the noise problem caused by the gear engaged transmission is fundamentally solved. Meanwhile, the blades are disposed on the driving wheel. As the driving wheel rotates for transmission, the blades generate airflow to cool heat of the transmission belt, thereby improving the service life of the transmission belt. With the blades on the driving wheel, the cooling effect of the fan on the first output shaft of the motor to the cylinder is further enhanced.

Further, the structure for the motor mounting seat and the cylinder mounting seat is provided reasonably. The extension portion for accommodating the driving wheel is disposed on the cylinder mounting seat. Moreover, the motor portion is quickly inserted into the cylinder portion and the power transmission portion through the threaded rod for mounting, simplifying the assembly process.

To sum up, the present disclosure realizes low noise, quick mounting, and enhanced cooling effect on the basis of the small air compressor.

In the figures: 1: motor, 101: first output shaft, 102: second output shaft, 2: fan, 3: driving wheel, 301: blade, 4: driven wheel, 5: transmission belt, 6: cam, 601: central shaft, 602: connecting shaft, 7: piston rod, 701: pivot hole, 8: piston, 9: cylinder barrel, 10: air outlet, 11: cylinder mounting seat, 111: heat sink, 112: end cover, 13: threaded rod, 14: extension portion, 141: first locating hole, 142: groove, 143: external extension portion, 144: air vent, 15: nut, 16: motor mounting seat, 161: second locating hole, 17: air guide housing, 18: bearing, 19: air tank, 20: air outlet pressure adjusting device, 21: first pressure gauge, 22: air outlet connector, 23: second pressure gauge, 24: safety valve, 25: air inlet tube, and 26: air outlet tube.

DETAILED DESCRIPTION OF THE EMBODIMENTS

The present disclosure will be further described below in conjunction with the accompanying drawings and specific embodiments, but the protection scope of the present disclosure is not limited thereto.

Figure 1:
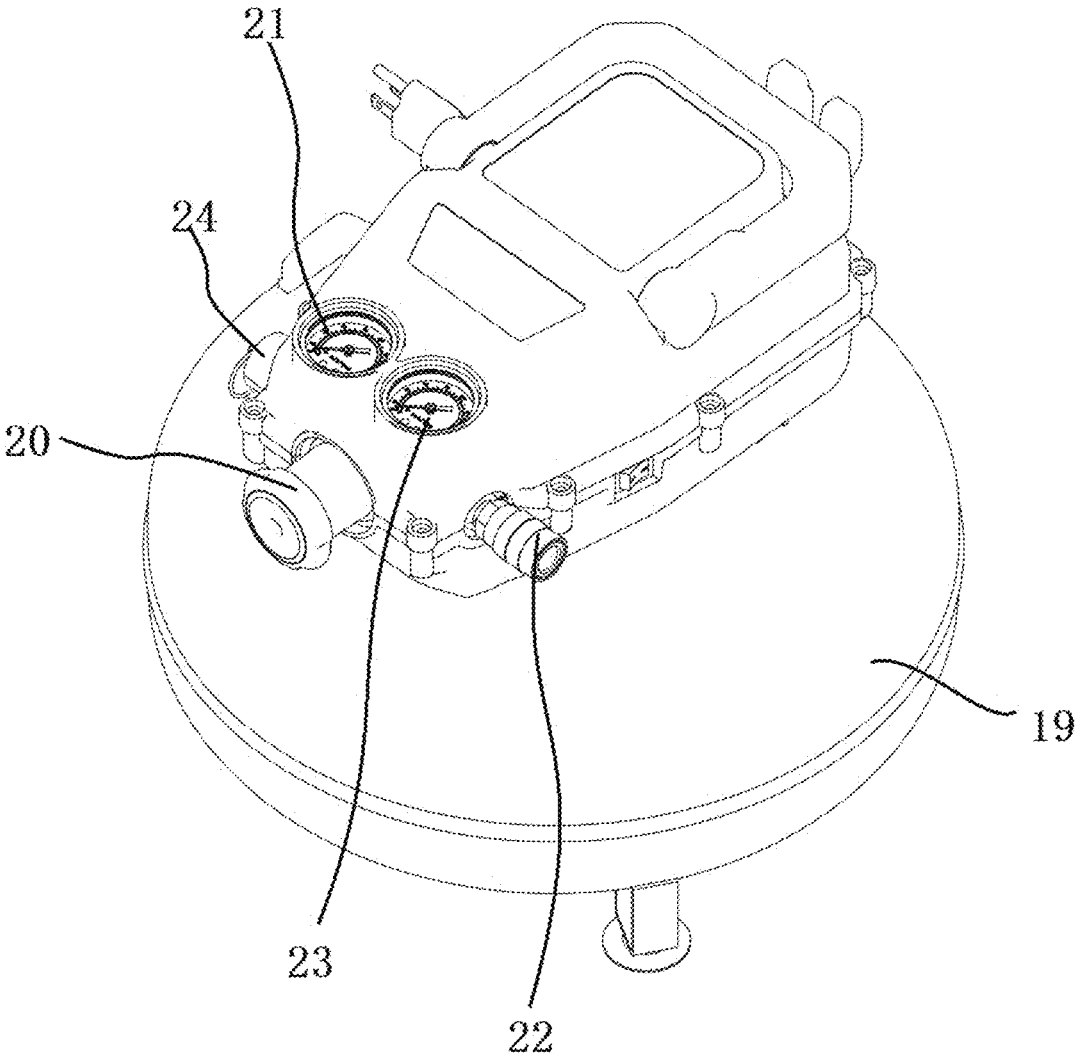
FIG. 1 illustrates an overall structure of a compact air compressor according to the present disclosure.
Figure 2:
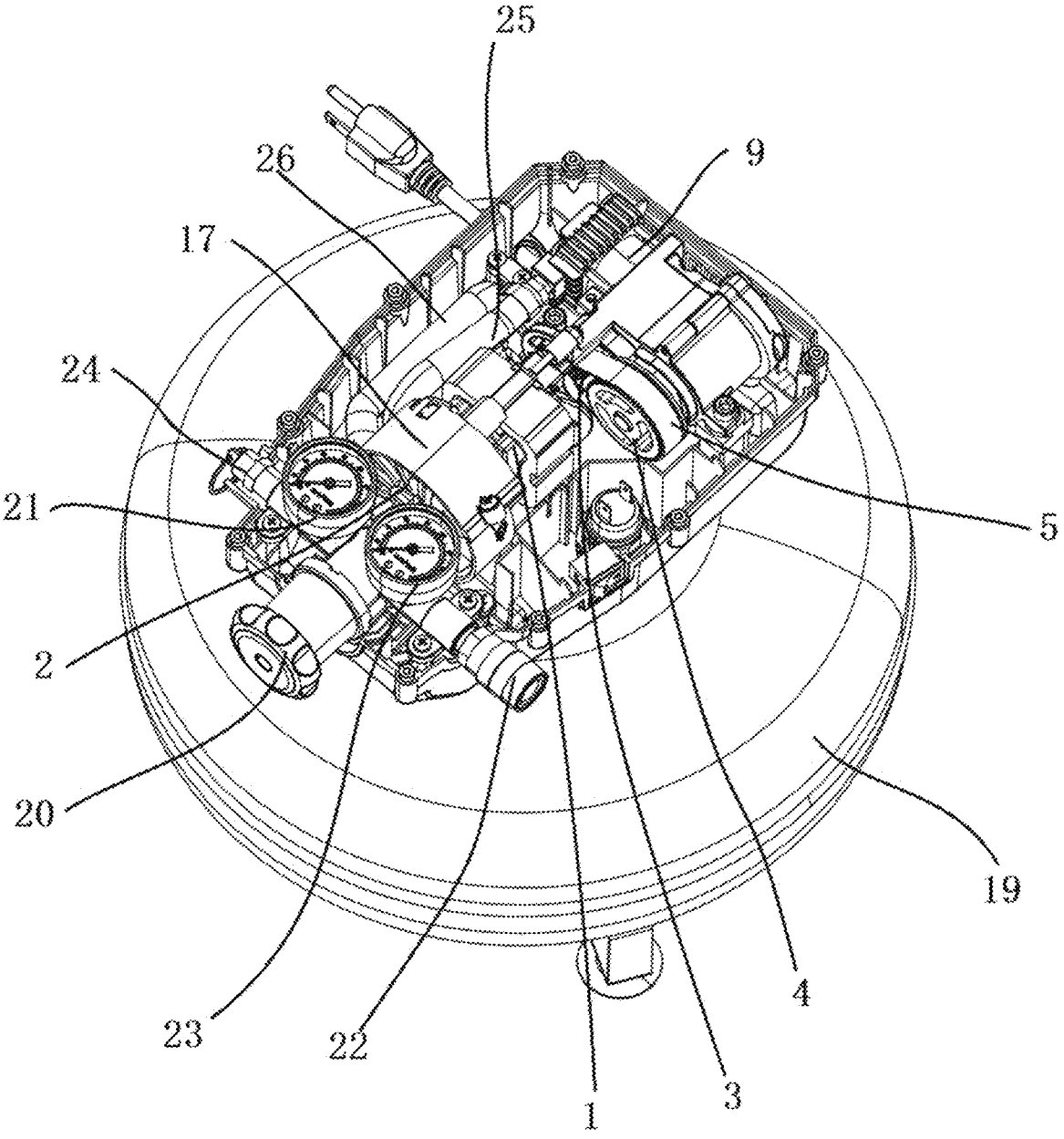
FIG. 2 illustrates an internal structure of a compact air compressor according to the present disclosure.
Figure 3:
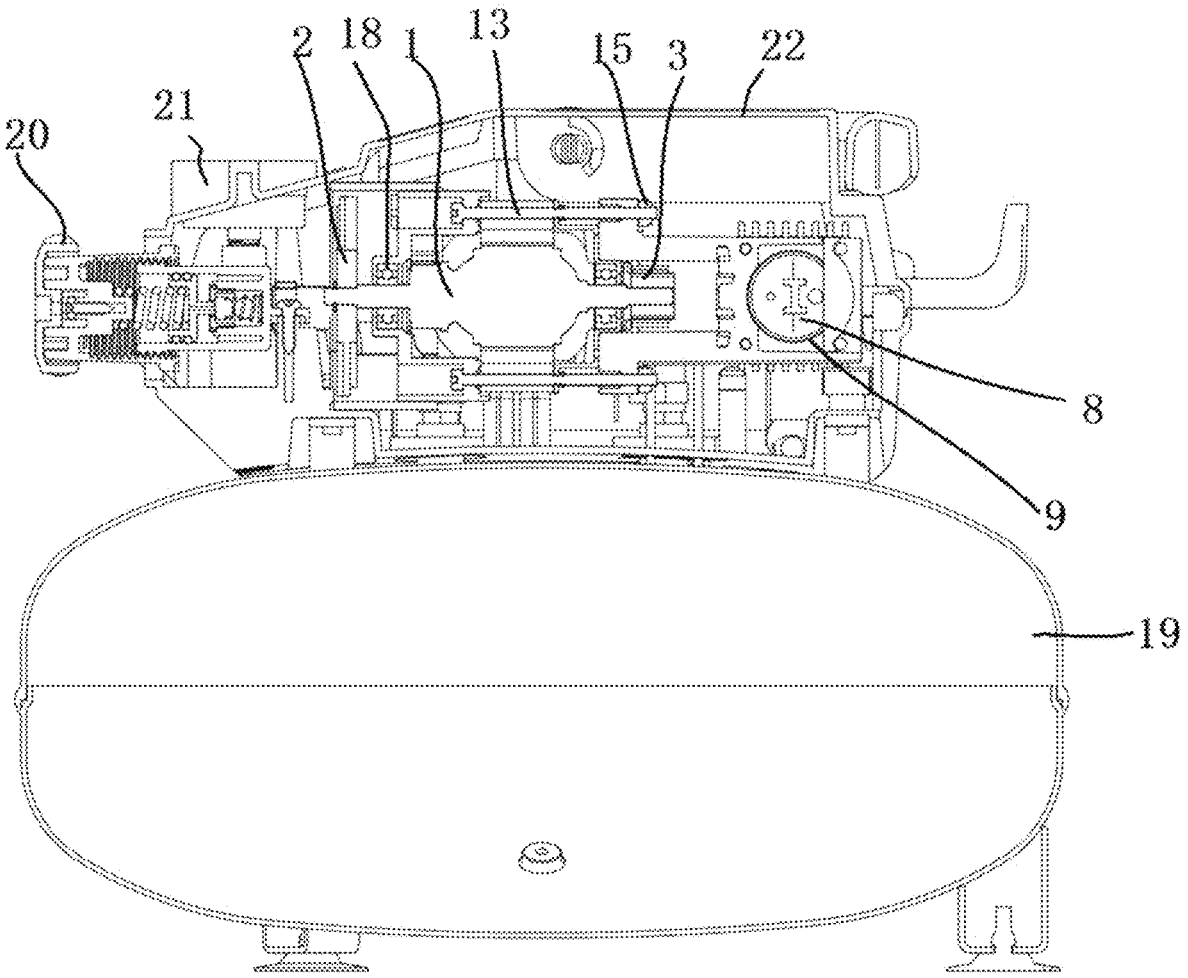
FIG. 3 is a sectional view of a compact air compressor according to the present disclosure.
Figure 4:
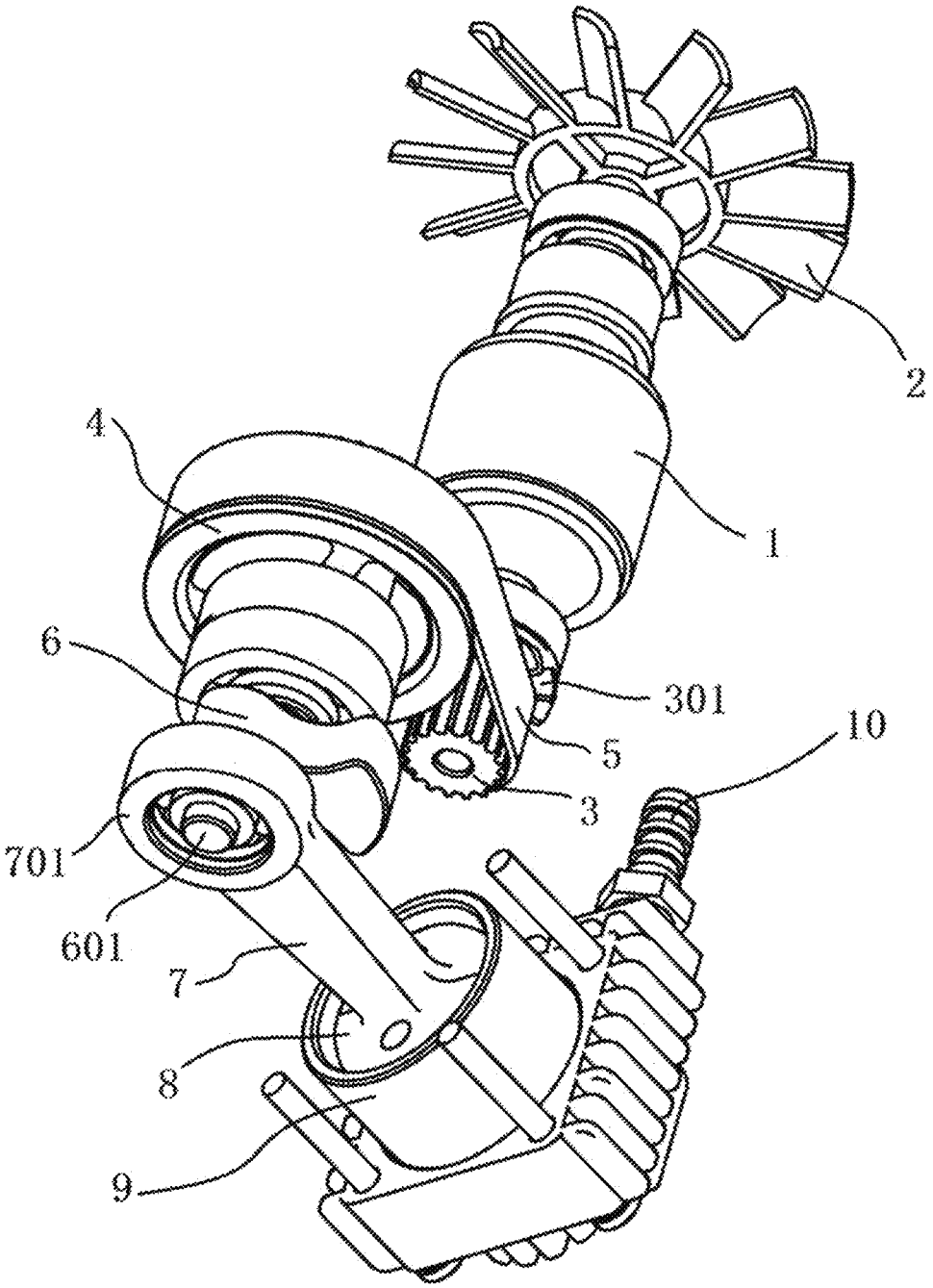
FIG. 4 is a structural view of a power transmission portion according to the present disclosure.

As shown in FIG. 1, FIG. 2 and FIG. 3, the present disclosure provides a compact air compressor, including an air tank, a casing disposed on a top of the air tank, and motor 1, fan 2, driving wheel 3, driven wheel 4, transmission belt 5, cam 6, and a cylinder that are located in the casing. The fan 2 is disposed on first output shaft 101 of the motor 1. The driving wheel 3 is disposed on second output shaft 102 of the motor 1. The motor 1 and the driving wheel 3 serve as a power output portion of the air compressor. The driven wheel 4, the cam 6, central shaft 601 on the cam 6, and connecting shaft 602 serve as a power transmission portion. The driven wheel 4 is disposed on the connecting shaft 602 that is connected to the cam 6. The central shaft 601 on the cam 6 extends into pivot hole 701 at a free end of piston rod 7 of the cylinder. The driven wheel 4 is in transmission connection with the driving wheel 3 through the transmission belt 5, as shown in FIG. 4. Bearing 18 is disposed between the first output shaft 101 of the motor 1 and a motor mounting seat, as well as between the second output shaft 102 of the motor 1 and the motor mounting seat. Air guide housing 17 is disposed outside the fan 2.

Power from rotation of the motor 1 is transferred to the driving wheel 3 through the second output shaft 102. The driving wheel 3 then transfers the power to the driven wheel 4 through the transmission belt 5. This prevents noise caused by original direct engaged transmission between the driven wheel 4 and the driving wheel 3 via a pair of gears. The rotational motion of the driven wheel 4 is converted into the reciprocating motion of the piston rod 7 through the cam 6, thereby pushing piston 8 to move back and forth in cylinder barrel 9. A bearing is disposed at an end of the central shaft 601. Through contact between the bearing and an interior of the pivot hole 701 of the piston rod 7, the piston rod 7 is driven to move back and forth.

In the view provided by the embodiment, the driving wheel 3 and the driven wheel 4 each are a toothed wheel. In this case, the transmission belt 5 is preferably a synchronous belt. Protrusions on an inner surface of a toothed belt are in one-to-one correspondence with grooves of the driven wheel and grooves of the driving wheel, which can realize complete synchronization of movement between the driven wheel and the driving wheel. As an alternative solution, the driving wheel 3 and the driven wheel 4 each may be a multi-wedge belt pulley, and the transmission belt 5 is a multi-wedge belt.

Figure 6:
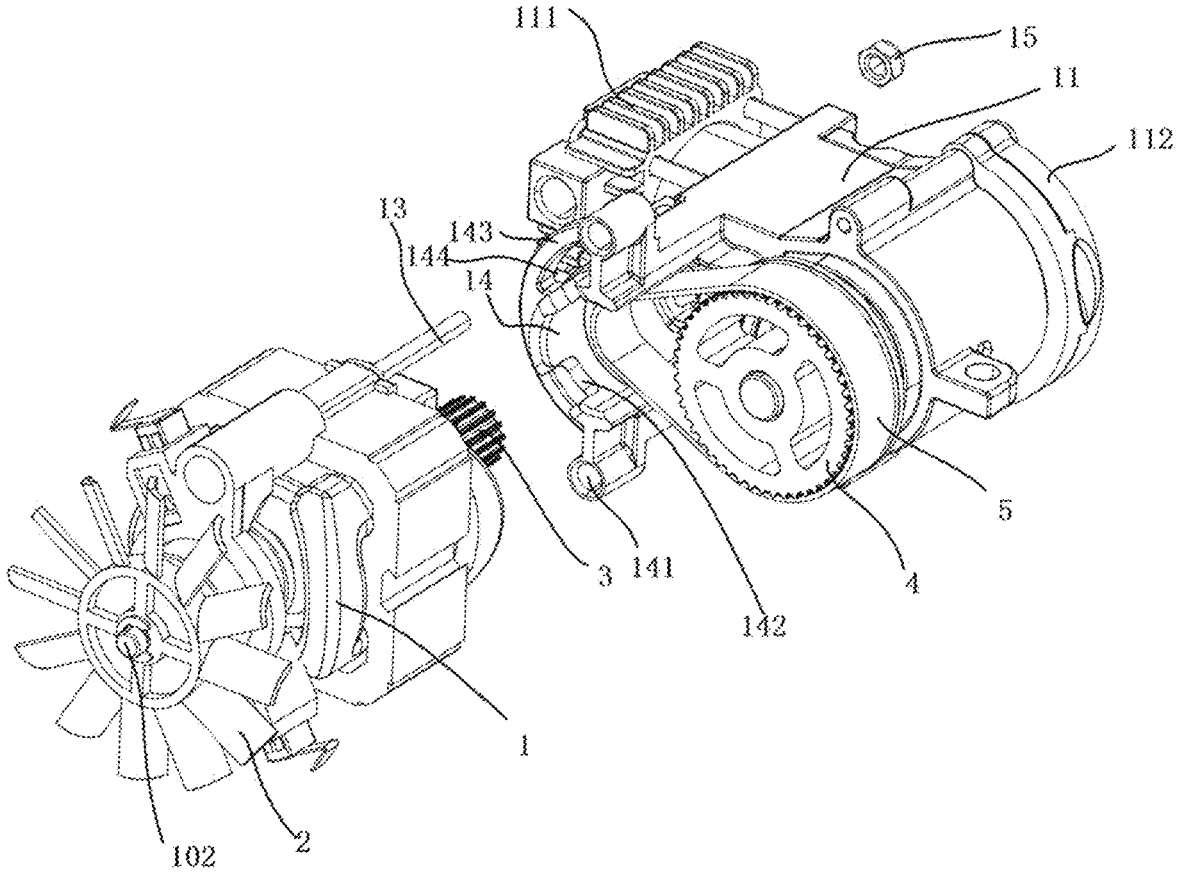
FIG. 6 is a schematic view of a motor portion and a cylinder portion in an insertion process.
Figure 7:
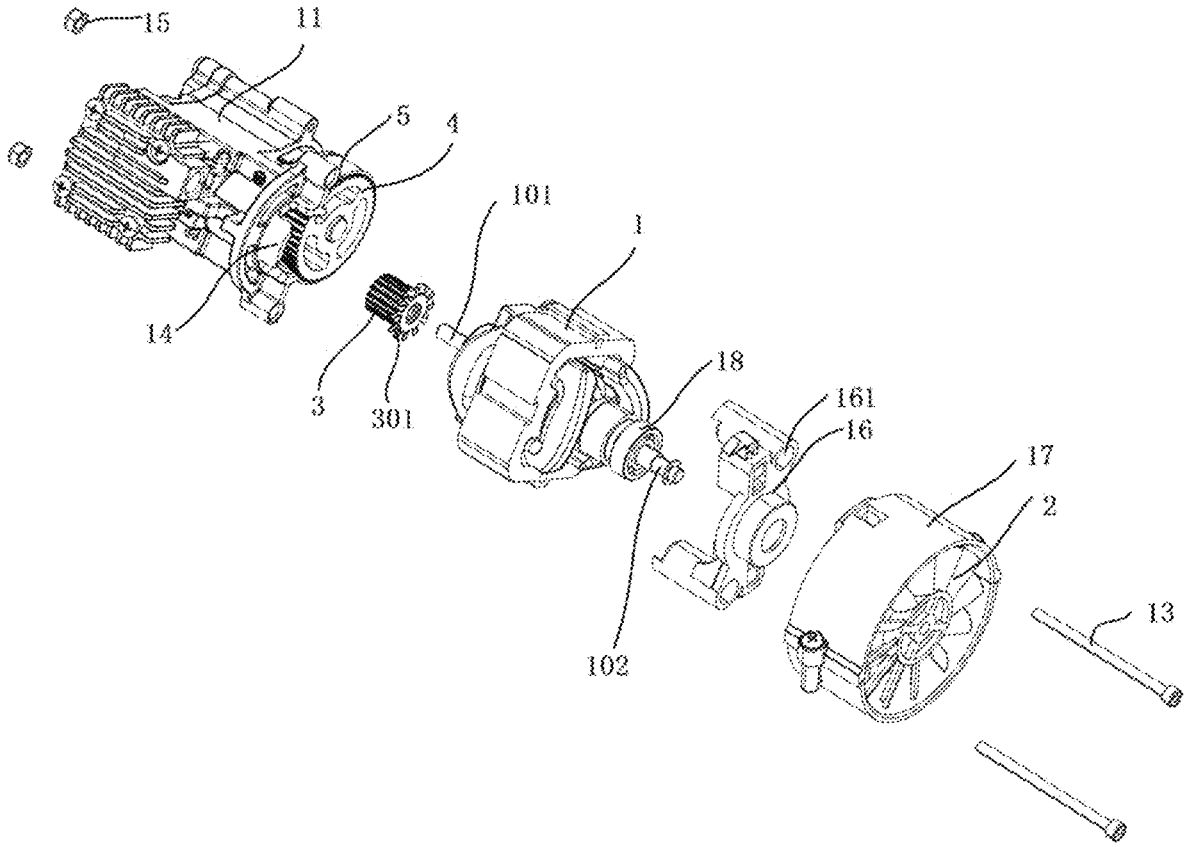
FIG. 7 is an exploded view of a power transmission portion.

The power output portion and the power transmission portion of the compact air compressor in the present disclosure are mounted in an insertion manner shown in FIG. 6 and FIG. 7. Specifically, extension portion 14 perpendicular to the cylinder and having an inner side being arc-shaped is disposed on a cylinder mounting seat, so as to accommodate the driving wheel 3. Second locating hole 161 is formed in the motor mounting seat 16. First locating hole 141 is correspondingly formed in the extension portion 14 of the cylinder mounting seat 11. One end of the transmission belt 5 is sleeved on the driven wheel 4. The other end of the transmission belt 5 is accommodated in the extension portion 14. The driving wheel 3 is inserted into the extension portion 14 and the transmission belt 5, and fastened by threaded rod 13 penetrating through the locating hole in the motor mounting seat 16 and the locating hole in the extension portion 14 as well as nut 15, thereby realizing quick mounting of the power output portion and the power transmission portion.

Figure 5:
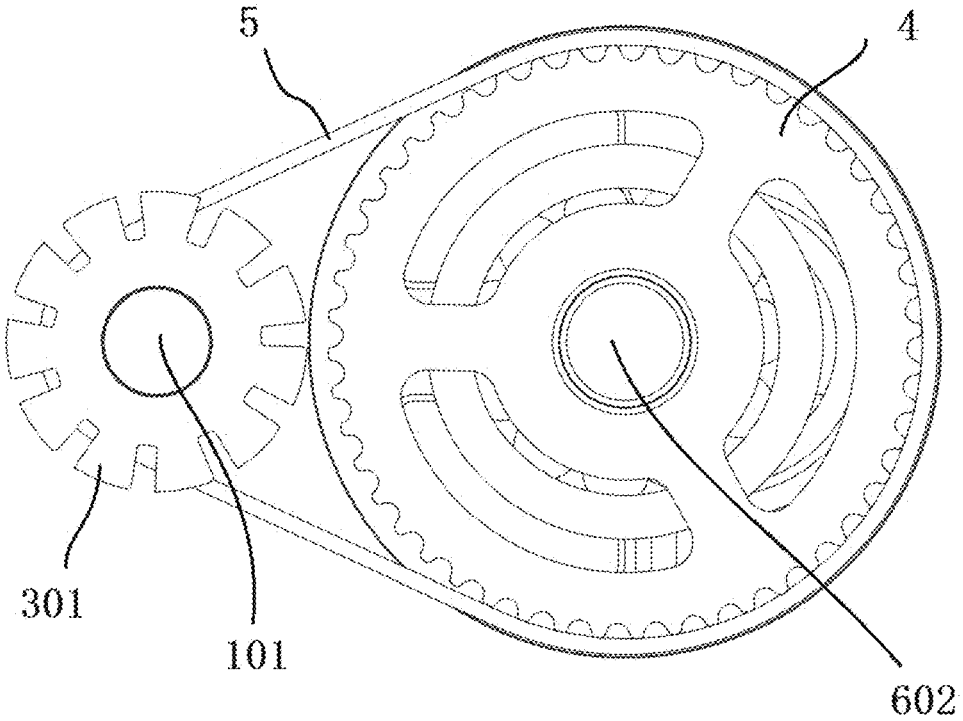
FIG. 5 illustrates a transmission structure for a driving wheel and a driven wheel.

As shown in FIG. 4 and FIG. 5, in the present disclosure, a plurality of blades 301 are disposed on the driving wheel 3. The blades 301 and the driving wheel 3 are integrally formed or fixed by welding. Meanwhile, a plurality of grooves 142 are formed at an end of the extension portion 14 to serve as an air inlet passage. As the driving wheel 3 rotates with the second output shaft 102, the blades 301 on the driving wheel 3 rotate together, generating an airflow that is blown to the transmission belt 5 to cool the transmission belt 5, thereby improving the service life of the transmission belt 5.

Under the driving of the motor, the fan 2 disposed on the first output shaft 101 of the motor 1 rotates, generating an airflow that is blown to the cylinder, thereby taking the heat away the cylinder. External extension portion 143 extending circumferentially relative to an arc of an inner wall of the extension portion 14 is disposed at an outer side of the extension portion 14. Air vent 144 is formed in the external extension portion 143, which can cool the position where the extension portion 14 is located, and can further improve the airflow capacity. In order to improve the heat dissipation effect, heat sink 111 is disposed on the cylinder mounting seat 11. Meanwhile, a plurality of protrusions are disposed on an inner wall of end cover 112 of the cylinder mounting seat 11, thereby reducing noise generated by air inflow to a pump head.

Air compressed by the cylinder is injected into the air tank 19 through air inlet tube 25 via air outlet 10 of the cylinder. High pressure air stored in the air tank 19 is delivered through air outlet tube 26 and air outlet connector 22. In order to detect an air pressure in the air tank 19 and an air outlet pressure, first pressure gauge 21 and second pressure gauge 23 are disposed at the air outlet connector 22. The air pressure in the air tank 19 is relieved through safety valve 24 when it is greater than a preset pressure. The air pressure output from the air outlet connector 22 is adjusted by air outlet pressure adjusting device 20 at the air outlet connector 22.

The above embodiments are preferred implementations of the present disclosure, but the present disclosure is not limited to the above implementations. Any obvious improvement, substitution, or modification made by those skilled in the art without departing from the essence of the present disclosure should fall within the protection scope of the present disclosure.

What is claimed is:

1. A compact air compressor, comprising: an air tank, a casing disposed on a top of the air tank, and a motor, a fan, a driving wheel, a driven wheel, a transmission belt, a cam, and a cylinder that are located in the casing, wherein the fan is disposed on a first output shaft of the motor; the driving wheel is disposed on a second output shaft of the motor; a plurality of blades are disposed on the driving wheel; the driven wheel is disposed on a connecting shaft that is connected to the cam; a central shaft on the cam extends into a pivot hole at a free end of a piston rod of the cylinder; a bearing is disposed at an end of the central shaft on the cam; through contact between the bearing and an interior of the pivot hole of the piston rod, the piston rod is driven to move back and forth;

an extension portion perpendicular to the cylinder is disposed on a cylinder mounting seat; an inner side of the extension portion is arc-shaped to accommodate the driving wheel; a plurality of grooves are formed at an end of the extension portion to serve as an air inlet passage; corresponding locating holes are respectively formed in a motor mounting seat and the extension portion of the cylinder mounting seat; the driving wheel is inserted into the extension portion, and connected by a threaded rod penetrating through the locating hole in the motor mounting seat and the locating hole in the extension portion as well as a nut;

an external extension portion extending circumferentially relative to an arc-shaped inner side of the extension portion is disposed at an outer side of the extension portion; an air vent is formed in the external extension portion; the driven wheel is in transmission connection with the driving wheel through the transmission belt; an air outlet of the cylinder communicates with the air tank through an air inlet tube and a one-way valve; the air tank communicates with an air outlet connector through an air outlet tube; and a first pressure gauge and a second pressure gauge that are respectively configured to detect an air pressure in the air tank and an air outlet pressure are disposed at the air outlet connector.

2. The compact air compressor according to claim 1, wherein the driving wheel and the driven wheel each are a toothed wheel, and the transmission belt is a synchronous belt; or the driving wheel and the driven wheel each are a multi-wedge belt pulley, and the transmission belt is a multi-wedge belt.

3. The compact air compressor according to claim 1, wherein the plurality of blades and the driving wheel are integrally formed or fixed by welding.

4. The compact air compressor according to claim 1, wherein a safety valve is disposed between the air outlet connector and the air outlet tube.

5. The compact air compressor according to claim 1, wherein an air outlet pressure adjusting device is disposed at the air outlet connector.

6. The compact air compressor according to claim 1, wherein a bearing is disposed between the first output shaft of the motor and the motor mounting seat, as well as between the second output shaft of the motor and the motor mounting seat; and an air guide housing is disposed outside the fan.

7. The compact air compressor according to claim 1, wherein a heat sink is disposed outside the cylinder mounting seat; and a plurality of protrusions are disposed on an inner wall of an end cover of the cylinder mounting seat.

* * * * *